United States Patent [19]

Burke

[11] 4,306,280

[45] Dec. 15, 1981

[54] MULTI-ADJUSTABLE SUPPORTING DEVICE

[76] Inventor: Peter Y. Burke, 9312 W. 87th Pl., Arvada, Colo. 80005

[21] Appl. No.: 957,986

[22] Filed: Nov. 6, 1978

[51] Int. Cl.[2] ..... F21V 21/00

[52] U.S. Cl. ..... 362/396; 362/147; 362/427; 362/432

[58] Field of Search ..... 362/147, 432, 427, 396; 248/324

[56] References Cited

U.S. PATENT DOCUMENTS 1,916,322 7/1933 Lindey ..... 362/427 X 2,388,474 11/1945 Ellis ..... 362/432 X

*Primary Examiner*—Stephen J. Lechert, Jr.

*Attorney, Agent, or Firm*—Sheridan, Ross, Fields & McIntosh

[57] ABSTRACT

An adjustable device is provided for supporting articles, such as lamps and potted plants. The device includes a stationary support member which is fixedly attached to a wall or other upstanding foundation. A coupling mechanism is movably connected at a first end to one end of the stationary support member. A swivel member is connected to a second end of the coupling mechanism by means of a pivot member to permit rotation of the swivel member along an arcuate path in a generally horizontal direction. In addition, a chain or cord interconnects the swivel member and the stationary support member to permit vertical movement of the swivel member relative to the stationary support member. Thus, a lamp or plant holder may be secured to the chain for convenient movement to a number of desirable, alternative positions.

3 Claims, 4 Drawing Figures

MULTI-ADJUSTABLE SUPPORTING DEVICE

TECHNICAL FIELD

This invention relates to adjustable supporting devices and in particular to a device for supporting a light source and its housing from a wall of a building and which is lockably movable along both a generally horizontal and a generally vertical arcuate path.

BACKGROUND ART

Typical lights and their housings are mounted on a surface such as the ceiling of a structure. The light housings may be suspended by chains from a hook fastened to the ceiling. The lamp may be raised or lowered vertically with respect to the ceiling by adjusting the length of the suspended chain.

The device disclosed herein, on the other hand, allows for a multitude of different lamp positions since it is lockable after being moved in both a generally horizontal direction as well as a generally vertical direction. The lamp, then, is conveniently positioned in a number of desirable locations.

DISCLOSURE OF INVENTION

In accordance with this invention, a multi-adjustable supporting device is provided for use with articles such as lamps or potted plant holders. A stationary support member is mounted on a base support such as a wall. A swivel support member is operably connected to the stationary support member so that the swivel support member is rotatable along an arcuate path in a generally horizontal direction. A hook attached to an end portion of the swivel support member and a hook attached to one end portion of the stationary support member receive a chain or cord which is adjusted to move the swivel support member relative to the stationary support member along an arcuate path in a generally vertical direction.

More particularly, a multi-adjustable support device is provided in combination with a light source and its housing to vary the horizontal and vertical position thereof. The device comprises a stationary support member which is fixedly attachable to a base support. The stationary support member includes a bore located generally adjacent a first end thereof. A securing member is recessably received in the bore to fixedly hold a first hook inserted therein. The stationary support member also has a plurality of holes which accept a number of attaching members or screws which are embedded into the base support to hold the stationary support thereagainst. A generally U-shaped flange or clevis having a pair of openings is connected to a second end of the stationary support member. A coupler having an aperture is connected to the clevis by a pivot member inserted through the coupler aperture and clevis openings. An adjusting member or nut releasably engages the clevis and the pivot member and thereby holds the coupler to the clevis. Also connected to the coupler is a swivel support member which has a groove located adjacent a first longitudinal end. The groove is axially aligned with a pair of passages formed in the coupler. A linking member having a pair of pin holes is inserted through the groove of the swivel support member and the passages of the coupler. A locking pin is inserted through each pin hole to secure the swivel support member to the coupler. At the longitudinal end opposite the groove formed end of the swivel support member, an extension member or second hook is fastened to the swivel support member.

A length of cord or chain interconnects the first hook of the stationary support member and the extension member of the swivel support member and is also attached to a light source housing so that adjusting the length of the chain between the first hook and the extension member moves the swivel support member relative to the stationary support member in a generally vertical direction thereby also moving the light source. Movement of the swivel support member in a generally horizontal direction is accomplished by releasing the adjusting member so that the coupler may be rotated relative to the stationary support member thereby also moving the swivel support member along an arcuate path.

The multi-adjustable supporting device of this invention provides a decorative structure which permits the positioning of a light source and housing attached thereto in a number of locations relative to a base support against which the device is mounted. Additional advantages of the invention will become apparent from the description which follows, taken in conjunction with the accompanying drawings.

BEST MODE FOR CARRYING OUT THE INVENTION

Figure 1:
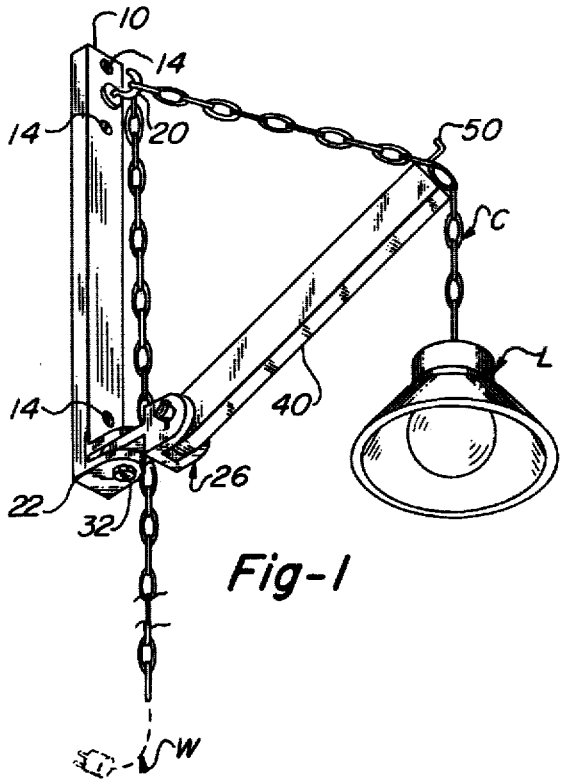
FIG. 1 is a perspective view of this invention showing a chain having a light source and housing attached thereto.

In accordance with this invention, a multi-adjustable support S is provided and to which a chain or cord C is attached. As shown in FIG. 1, a light source and housing L is fastened to one end of the chain C. An insulated electrical wire W is adaptable to electrically connect the light source or lamp L to a source of electrical power. Although the adjustable support S is shown in combination with a lamp L, it can be appreciated that this device may also be used to support potted plant holders and similar items.

Figure 4:
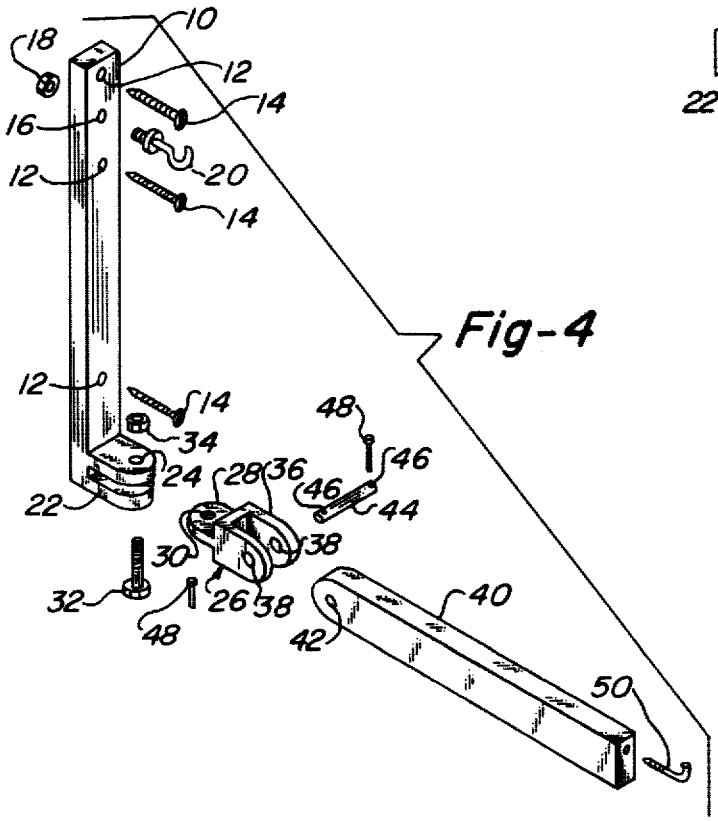
FIG. 4 is an exploded view showing the parts of this invention.

As best seen in FIG. 4, support S includes a stationary support member 10 having a plurality of spaced holes 12 for receiving a number of attaching member or screws 14. Attaching members 14 may be embedded into a base support such as a wall of a house or other building so that stationary support member 10 is held thereagainst. Stationary support member 10 further includes, adjacent a first longitudinal end thereof, a bore 16 which accepts securing member 18 so that securing member 18 is completely contained within bore 16. A hook 20 is then inserted through securing member 18 to be fixedly held therein.

A second longitudinal end of stationary support member 10 is connected to a generally U-shaped flange or clevis 22 having a pair of openings 24. A coupler 26 having a projecting end 28 with an aperture 30 is placed between the openings 24 of flange 22 so that aperture 30 is axially aligned with openings 24. After alignment, pivot member 32 is inserted through openings 24 and aperture 30 to connect coupler 26 to flange 22. Subsequently, adjusting member or nut 34 releasably tightens coupler 26 to flange 22.

Coupler 26 also includes a base piece 36 having a pair of passages 38. A swivel support member or boom 40 having a groove or hole 42 formed at a first longitudinal end thereof is accepted between the passages 38 such that the groove 42 is axially aligned therewith. A linking member or rod 44 having pin holes 46 is then inserted through the passages 38 and groove 42 to connect swivel support member 40 to coupler 26. A locking pin 48 is inserted into each of the pin holes 46 to secure linking member 46 to coupler 26.

Attached to a second longitudinal end of the swivel support member 40, opposite the end containing groove 42, is an extension member or second hook 50 which extends outwardly from swivel support member 40. As seen in FIG. 1, a link of chain C is fastened to extension member 50 while another link of chain C is fastened to hook 20 thereby interconnecting stationary support member 10 and swivel support member 40.

Figure 2:
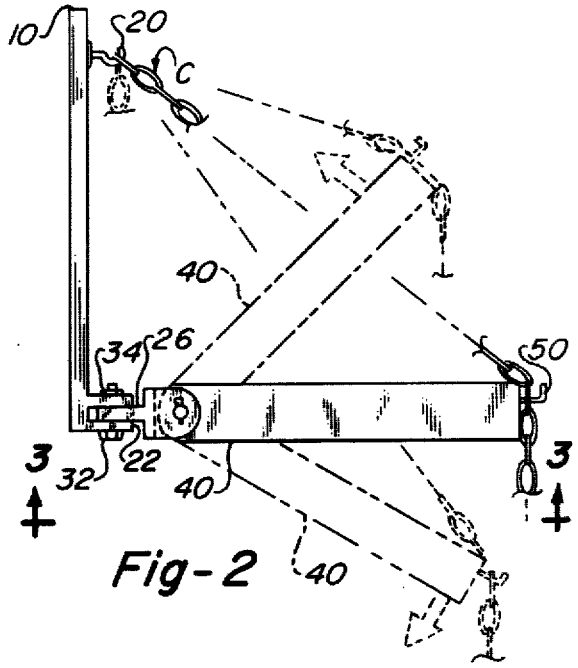
FIG. 2 is a side elevational view of this invention showing the movement of the swivel support member relative to the stationary support member along an arcuate path in a generally vertical direction.

Adjustment of the light source and housing L relative to stationary support member 10 along an arcuate path in a generally vertical direction is best seen in FIG. 2. Vertical movement of the lamp in a downwardly direction may be accomplished by increasing the length of chain C between hook 20 and extension member 50. Movement of the swivel support member about linking member 44 occurs when this chain length is varied. Similarly, vertical movement of the lamp L in an upwardly direction may be accomplished by decreasing the length of chain C between hook 20 and extension member 50. Alternatively, the lamp L may be lowered vertically by increasing the length of chain C between extension member 50 and the chain connecting point on the lamp. Likewise, lamp L may be raised vertically by decreasing the length of chain C between extension member 50 and the chain connecting point on the lamp L.

Figure 3:
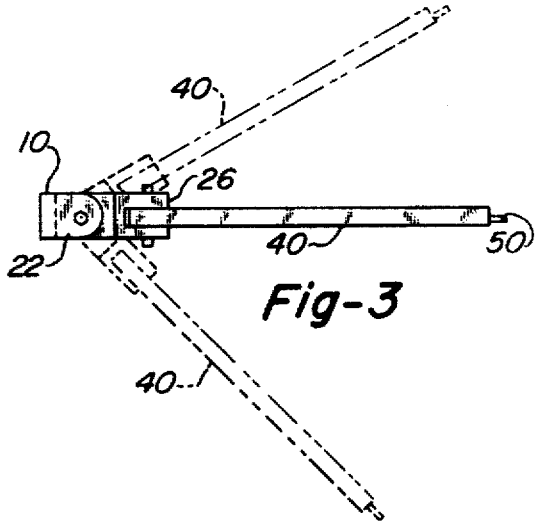
FIG. 3 is a top plan view of this invention showing the movement of the swivel support member relative to the stationary support member along an arcuate path in a generally horizontal direction.

Adjustment of the light source and housing L along an arcuate path in a generally horizontal direction is best seen in FIG. 3. Adjusting member 34 is untightened to permit rotation of coupler 26 in clevis 22 such that aperture 30 of projecting end 28 maintains axial alignment with openings 24 of clevis 22. Rotation of coupler 26 is provided about pivot member 32. Upon reaching any desired horizontal lamp position, slight tightening of adjusting member 34 increases the friction of the clevis 22 against the coupler 26 thereby preventing the swivel support member from further movement along the horizontal arcuate path.

From the foregoing, the advantages of this invention are readily apparent. An article support which may be positioned at a multitude of suitable points along both generally horizontal and vertical arcuate paths is provided. Movement of a light source, potted plant holder, or another similar article attached to the support is facilitated. it can be appreciated that such a capability assures a large measure of flexibility in the positioning and subsequent use of such attachable items.

This invention has been described in detail with particular reference to a plurality of embodiments thereof, but it will be understood that variations and modifications can be affected within the spirit and scope of the invention.

I claim:

1. A device for supporting and adjusting the position of an article, comprising:

stationary support means having a hook connected to the top end thereof, said stationary support means being attachable to a base support;

swivel support means having an extension member connected to an end thereof, said swivel support means rotatably connected to said stationary support means so that said swivel support means is movable along a generally horizontal arcuate path relative to said stationary support means; and means for movably connecting said stationary support means and said swivel support means so that said swivel support means is movable along a generally vertical arcuate path relative to said stationary support means, said movable connecting means being a length of cord extending vertically adjacent said stationary support means and removably connected to said hook at a first point along the length of said cord, said cord extending from said hook to said extension member and removably connected at a second point along the length of said cord to said extension member, said cord extending from said extension member to support the article at a third point along the length of said cord so that adjusting the cord length between said hook and said extension member moves the article along a substantially vertical arcuate path.

2. The device, as claimed in claim 1, wherein:

said swivel support means is connected to coupler means, said coupler means including:

a projecting end having an aperture axially aligned with openings in a bottom end of said stationary support means;

a base piece having a pair of passages axially aligned with a hole in said swivel support means;

a pivot member inserted through said openings of said bottom end of said stationary support means and said aperture of said projecting end to connect said coupler means to said stationary support means so that said swivel support means is rotatable about said pivot member along a substantially horizontal arcuate path; and a linking member inserted through said passage of said base piece and said hole of said swivel support means to connect said coupler means to said swivel support means so that said swivel support means is freely rotatable about said linking member along a substantially vertical arcuate path.

3. A multi-adjustable support device for attachment to a base support in combination with a light source, comprising:

a light source including a length of insulated conductor wire for connection to a source of electrical power;

a movable length of chain connected to said light source;

a stationary support member having a plurality of holes longitudinally spaced from each other and a bore adjacent a first end of said stationary support member;

a securing member recessably received in said bore;

a hook inserted into said bore and fixedly held therein by said securing member and connected to said length of chain at a first point thereof;

a plurality of attaching members, each of said attaching members inserted through said holes for mounting said stationary support member against the base support;

a generally U-shaped flange having a pair of openings and connected to a second end of said stationary support means;

a projecting end having an aperture axially aligned with each of said openings of said U-shaped flange;

a base piece having a pair of passages and integrally connected to said projecting end to form a coupler;

a swivel support member having a groove at a first end being axially aligned with each of said passages of said base piece;

a pivot member inserted through said U-shaped flange openings and said projecting end aperture to rotatably connect said coupler to said stationary support member;

an adjusting member releasably engaging said pivot member so that said coupler is securably held to said U-shaped flange;

a linking member having a pair of pin holes inserted through said base piece passages and said swivel support member groove to connect said coupler to said swivel support member so that said swivel support member is movable about said linking member in a substantially vertical arcuate path and said swivel support member is rotatable about said pivot member through the interconnection with said coupler in a substantially horizontal arcuate path;

a pair of locking pins, each locking pin inserted through one of said pin holes, to securely hold said linking member in said passages of said base piece and said groove of said swivel support member; and an extension member fastened to a second end of said swivel support member and connected to said length of chain at a second point thereof so that adjusting the distance between said first and second points of said chain alters the vertical position of said light source.

* * * * *